US009249657B2

(12) United States Patent
Sipilä et al.

(10) Patent No.: US 9,249,657 B2
(45) Date of Patent: Feb. 2, 2016

(54) SYSTEM AND METHOD FOR MONITORING A SUBSEA WELL

(71) Applicant: General Electric Company, Schenectady, NY (US)

(72) Inventors: Pekka Tapani Sipilä, Munich (DE); Nicholas Josep Ellson, Bristol (GB); David John Buttle, Wantage (GB); John Charles McCarthy, Compton (GB); Sakethraman Mahalingam, Chennai (IN)

(73) Assignee: General Electric Company, Niskayuna, NY (US)

( * ) Notice: Subject to any disclaimer, the term of this patent is extended or adjusted under 35 U.S.C. 154(b) by 591 days.

(21) Appl. No.: 13/664,482

(22) Filed: Oct. 31, 2012

(65) Prior Publication Data

US 2014/0116715 A1 May 1, 2014

(51) Int. Cl.

| | |
|---|---|
| ***E21B 47/001*** | (2012.01) |
| ***E21B 47/01*** | (2012.01) |
| ***E21B 47/06*** | (2012.01) |
| ***E21B 41/00*** | (2006.01) |
| ***E21B 47/10*** | (2012.01) |

(52) U.S. Cl.

CPC ..... *E21B 47/01* (2013.01); *E21B 41/0007* (2013.01); *E21B 47/06* (2013.01); *E21B 47/102* (2013.01); *E21B 47/1025* (2013.01)

(58) Field of Classification Search

CPC . E21B 41/0007; E21B 47/0001; E21B 47/01; E21B 47/06; E21B 47/102; E21B 47/1025

USPC ..... 166/336, 368, 250.01; 340/853.1

See application file for complete search history.

(56) References Cited

U.S. PATENT DOCUMENTS

| | | | | |
|---|---|---|---|---|
| 3,974,690 | A * | 8/1976 | Brock et al. | 73/152.51 |
| 4,766,764 | A * | 8/1988 | Trevillion | 73/152.56 |
| 5,492,017 | A | 2/1996 | Jennings et al. | |
| 6,513,596 | B2 * | 2/2003 | Wester | 166/336 |
| 6,751,556 | B2 * | 6/2004 | Schroeder et al. | 702/6 |

(Continued)

OTHER PUBLICATIONS

F.C. Adamek P.E. et al.; Non Intrusive Sensors—An Answer to Annulus Pressure Monitoring in Subsea Wellhead Equipment; Offshore Technology Conference; Presented at the 27th Annual OTC in Houston, Texas, USA; May 1-4, 1995; pp. 479-491.

(Continued)

*Primary Examiner* — Matthew R Buck
(74) *Attorney, Agent, or Firm* — Seema S. Katragadda

(57) ABSTRACT

A system for monitoring a subsea well is presented. The system includes the subsea well, where the subsea well includes a production tube, an annulus A co-axial to the production tube and positioned exterior to the production tube, an annulus B co-axial to the annulus A and positioned exterior to the annulus A, and a casing wall disposed between the annulus A and annulus B. Furthermore, the system includes a first sensor disposed on or about the production tube, the annulus A, the casing wall, or combinations thereof and configured to measure a first parameter. The system also includes a controller coupled to the subsea well and configured to analyze the first parameter measured by the first sensor and detect an anomaly in one or more components of the subsea well. Methods and non-transitory computer readable medium configured to perform the method for monitoring a subsea well are also presented.

24 Claims, 12 Drawing Sheets

(56) References Cited

U.S. PATENT DOCUMENTS

| | | | | |
|---|---|---|---|---|
| 7,163,055 | B2 * | 1/2007 | Coon et al. | 166/250.01 |
| 7,219,729 | B2 * | 5/2007 | Bostick et al. | 166/250.01 |
| 7,243,557 | B2 * | 7/2007 | May | 73/862.331 |
| 7,245,791 | B2 * | 7/2007 | Rambow et al. | 385/12 |
| 7,261,162 | B2 * | 8/2007 | Deans et al. | 166/336 |
| 7,622,916 | B2 | 11/2009 | Meeten et al. | |
| 7,646,945 | B2 | 1/2010 | Jones et al. | |
| 7,921,916 | B2 * | 4/2011 | Lovell et al. | 166/336 |
| 7,931,090 | B2 * | 4/2011 | Smedstad et al. | 166/366 |
| 7,967,066 | B2 | 6/2011 | McStay et al. | |
| 7,980,305 | B2 | 7/2011 | Judge et al. | |
| 8,122,975 | B2 | 2/2012 | Belcher et al. | |
| 8,312,923 | B2 * | 11/2012 | Patel et al. | 166/250.01 |
| 8,683,859 | B2 * | 4/2014 | Godager | 73/152.54 |
| 8,689,621 | B2 * | 4/2014 | Godager | 73/152.54 |
| 8,797,033 | B1 * | 8/2014 | Girrell et al. | 324/318 |
| 8,955,583 | B2 * | 2/2015 | Raynal et al. | 166/75.11 |
| 2001/0013410 | A1 * | 8/2001 | Beck et al. | 166/65.1 |
| 2003/0052670 | A1 * | 3/2003 | Miszewski | 324/228 |
| 2003/0098799 | A1 * | 5/2003 | Zimmerman | 340/854.6 |
| 2005/0001612 | A1 | 1/2005 | Buttle | |
| 2005/0283276 | A1 | 12/2005 | Prescott et al. | |
| 2006/0033638 | A1 * | 2/2006 | Hall et al. | 340/854.6 |
| 2007/0132605 | A1 * | 6/2007 | Beique et al. | 340/854.3 |
| 2008/0007421 | A1 * | 1/2008 | Liu et al. | 340/853.3 |
| 2008/0257548 | A1 | 10/2008 | Shaw et al. | |
| 2009/0301224 | A1 * | 12/2009 | Sihler et al. | 73/862.333 |
| 2010/0236339 | A1 | 9/2010 | Buttle et al. | |
| 2011/0308788 | A1 * | 12/2011 | Ravi et al. | 166/250.01 |
| 2012/0060625 | A1 | 3/2012 | Dietz | |
| 2012/0132417 | A1 * | 5/2012 | Dria et al. | 166/250.01 |
| 2013/0180726 | A1 * | 7/2013 | Ross et al. | 166/336 |
| 2013/0269945 | A1 * | 10/2013 | Mulholland et al. | 166/336 |

OTHER PUBLICATIONS

Simon Lindroth et al.; Offshore wave power measurements—A review; Renewable and Sustainable Energy Reviews; 2011; vol. 15, pp. 4274-4285.

Tahmineh Nazari; UKF-Based Estimation Fusion of Underbalanced Drilling Process Using Pressure Sensors; International Instrumentation and Measurement Technology Conference; May 5-7, 2009; 6 Pages.

* cited by examiner

SYSTEM AND METHOD FOR MONITORING A SUBSEA WELL

BACKGROUND

The invention relates generally to monitoring of components of a subsea well and more specifically to monitoring of pressure/stress in annulus A and annulus B in the subsea well.

In hydrocarbon production, risers, wellheads, and Christmas trees are used as physical interfaces to aid in the flow of hydrocarbons from an oil well to an oil producing asset. To ensure effective collection of hydrocarbons, it is desirable to actively monitor the integrity of a subsea well. The integrity of the subsea well may be compromised due to leakages in production tube, casings or cement work of a well or a wellhead structure, thereby causing pressure to build up in the annulus such as annulus A and annulus B of the subsea well. In certain cases, the tubing of the subsea well may collapse if the pressure difference between different annuli exceeds a threshold value. Therefore, measuring pressure in the annuli and/or the stress in the casing of the subsea wells is crucial for detecting any compromise in the integrity of subsea wells.

Conventionally, pressure sensing in the annulus A of a subsea wellhead is accomplished using traditional pressure sensors. Also, in subsea applications, regulations prohibit any drilling/wiring through a casing wall between the annulus A and B. Accordingly, due to the lack of direct access to the annulus B, measurement of the pressure in the annulus B may be accomplished by disposing a pressure sensor in the annulus B. In addition, disposing the sensor in the annulus B entails providing a communication link and a power supply to the sensor without penetrating the annulus B, in order to avoid a potential leak path in the annulus B. Moreover, these pressure sensors may experience failures due to aging, dirt, moisture, changes in the composition of the ambient fluid, and the like. Replacement of the defective sensors is a challenging task.

BRIEF DESCRIPTION

In accordance with aspects of the present disclosure, a system for monitoring a subsea well is presented. The system includes the subsea well including a production tube, an annulus A co-axial to the production tube and positioned exterior to the production tube, an annulus B co-axial to the annulus A and positioned exterior to the annulus A, and a casing wall disposed between the annulus A and the annulus B. Furthermore, the system includes a first sensor disposed on or about the production tube, the annulus A, the casing wall, or combinations thereof and configured to measure a first parameter. Also, the system includes a controller operatively coupled to the subsea well and configured to analyze the first parameter measured by the first sensor and detect an anomaly in one or more components of the subsea well.

In accordance with another aspect of the present disclosure, a method for monitoring a subsea well is presented. The method includes disposing a first sensor on or about one or more of a production tube, an annulus A, and a casing wall of the subsea well, where the first sensor is configured to measure a first parameter. Furthermore, the method includes analyzing the measured first parameter using a controller. In addition, the method includes identifying an anomaly in one or more components of the subsea well based on analysis of the first parameter. Also, a non-transitory computer readable medium configured to perform the method for monitoring a subsea well is presented.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Unless defined otherwise, technical and scientific terms used herein have the same meaning as is commonly understood by one of ordinary skill in the art to which this disclosure belongs. The terms "first", "second", and the like, as used herein do not denote any order, quantity, or importance, but rather are used to distinguish one element from another. Also, the terms "a" and "an" do not denote a limitation of quantity, but rather denote the presence of at least one of the referenced items. The term "or" is meant to be inclusive and mean one, some, or all of the listed items. The use of "including," "comprising" or "having" and variations thereof herein are meant to encompass the items listed thereafter and equivalents thereof as well as additional items. The terms "connected" and "coupled" are not restricted to physical or mechanical connections or couplings, and can include electrical connections or couplings, whether direct or indirect. Furthermore, the terms "circuit" and "circuitry" and "controller" may include either a single component or a plurality of components, which are either active and/or passive and are connected or otherwise coupled together to provide the described function.

As will be described in detail hereinafter, various embodiments of an exemplary system and method for monitoring a subsea well are presented. Furthermore, since the exemplary systems and method utilize a magnetostrictive technique, the sensing is robust against aging, dirt, moisture, changes in the composition of the ambient fluid, and the like.

Figure 1:
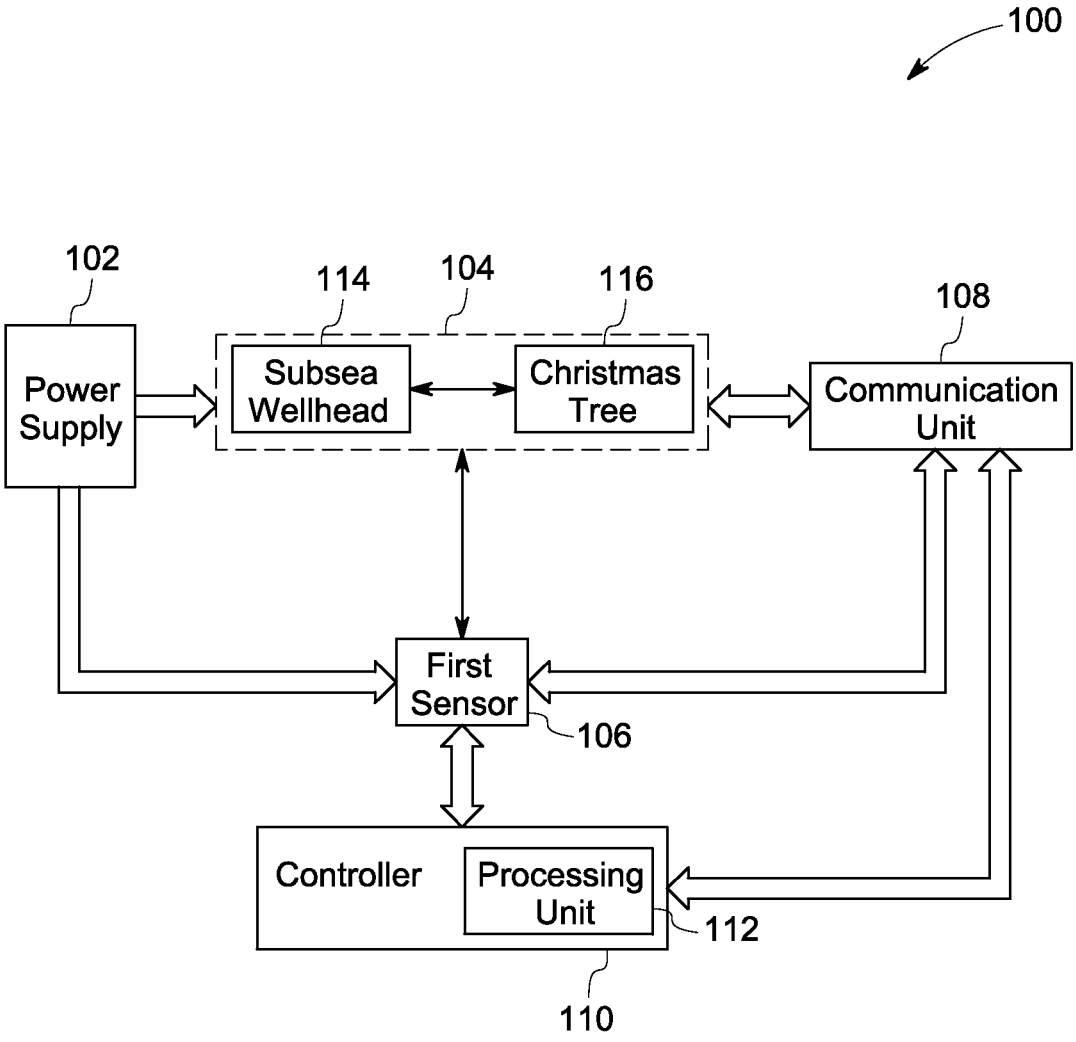
FIG. 1 is a diagrammatical representation of an exemplary system for subsea well monitoring, in accordance with aspects of the present disclosure.

Turning now to the drawings, by way of example in FIG. 1, an exemplary embodiment of a system 100 for monitoring a subsea well, in accordance with aspects of the present disclosure, is depicted. In one embodiment, the system 100 for monitoring the subsea well may include a power supply 102, a subsea well 104, and a first sensor 106. The system 100 may also include a communication unit 108 and a controller 110. The power supply 102 may include a battery, a direct current source, an alternating current source, and the like. Furthermore, the power supply 102 may be operatively coupled to the first sensor 106 and may be configured to energize the first sensor 106. In one non-limiting example, the controller 110 may be a subsea control module (SCM). Although the embodiment of FIG. 1 depicts the communication unit 108 and the controller 110 as separate units, in certain other embodiments, the controller 110 may include the communication unit 108.

Furthermore, in one embodiment, the subsea well 104 may include a subsea wellhead 114 and a Christmas tree 116 operatively coupled to each other. Furthermore, a riser may be coupled to the subsea well 104. A combination of the riser and the subsea well 104 may be referred to as a production facility. Also, the subsea well 104 may include a production tube, an annulus A, an annulus B, and a casing wall between the annulus A and the annulus B (see FIGS. 3 and 4). In one example, this casing wall may be made of a high strength steel alloy. Also, the annulus A may be co-axial to the production tube and positioned exterior to the production tube. Further, the annulus B may be co-axial to the annulus A and positioned exterior to the annulus A. The riser may be coupled to the subsea wellhead 114 via the Christmas tree 116. In addition, the riser may also be coupled to the subsea wellhead 114 via subsea flow lines, subsea jumpers, and subsea manifolds.

Moreover, in one embodiment, the first sensor 106 may be disposed on or about the production tube, the annulus A, the casing wall, and the like. In addition, the communication unit 108 may be operatively coupled to the first sensor 106. The communication unit 108 may be configured to transmit or receive a first parameter measured by the first sensor 106. In one non-limiting example, the communication unit 108 may be disposed at a remote location. In another example, the communication unit 108 may be placed on or about the production tube, the annulus A, the casing wall, and the like. Also, the communication unit 108 may include electronic circuitry such as a transmitter, a receiver, and the like. In one example, the transmitter of the communication unit 108 may be disposed on or about the production tube, the annulus A, and the casing wall and the receiver of the communication unit 108 may be disposed at a remote location. Furthermore, the power supply 102 and the communication unit 108 may be operatively coupled to the first sensor 106 using a wired connection, a wireless connection, and the like. It may be noted that in certain embodiments, the power supply 102 may be an integral part of the subsea well 104.

Also, the controller 110 may be operatively coupled to the communication unit 108. The first parameter measured by the first sensor 106 may be communicated from the first sensor 106 to the controller 110 by the communication unit 108. The term first parameter, as used herein, may include pressure, compression stress, hoop stress, residual stress, longitudinal stress, tensional stress, bending stress, torque induced stress, and the equivalents thereof. In one embodiment, the controller 110 may include a processing unit 112. The processing unit 112 may be configured to analyze the first parameter measured by the first sensor 106. Furthermore, the processing unit 112 may be configured to identify a fault in one or more components of the subsea well 104 based on analysis of the first parameter. Also, the fault in one or more components of subsea well 104 may include fault in a casing wall, cement employed in the subsea well 104, the production tube, the subsea wellhead 114, a tubing hanger, or other subsea well structures. In addition, based on the identification of fault, the controller 110 may be configured to regulate the pressure in the annulus A, the production tube, and/or other components of the subsea well 104.

Moreover, the first sensor 106 may include a fixed sensor, a wire-line tool, or a combination thereof. In one example, the fixed sensor may include a magnetic field sensor, a magnetostrictive sensor, a Villari effect sensor, an inductive coil, an acoustic transducer, an optical fiber, or combinations thereof. In one non-limiting example, two first sensors 106 may be disposed on or about the production tube, the annulus A, and the casing wall. The two first sensors 106 may be disposed in two different directions. Accordingly, the two first sensors 106 may be configured to measure stress in a first direction and a second direction. In particular, a biaxial stress may be measured using the two first sensors. Also, in one example, the first direction may be along the axis of the production tube, the annulus A, and the casing wall. The second direction may be along the circumference of the production tube, the annulus A, and the casing wall. The stress in the first direction may be an axial stress and the stress in the second direction may be a hoop stress. In another example, a single first sensor may be configured to measure stress in both the first direction and the second direction. Furthermore, the wire-line tool may be a sensor coupled to a wire-line cable, which may be introduced into the production tube or the annulus A through a service access of the production tube or the annulus A.

In one embodiment, the wire-line tool may be in a compressed form or a closed condition when it is introduced into the production tube or the annulus A through the service access. Once the wire-line tool is introduced into the production tube or the annulus A, the wire-line tool may be configured to open up for enabling the inspection. For example, the wire-line tool may be introduced into the production tube for inspecting the production tube. In another embodiment, the wire-line tool may be miniaturized to aid entry of the wire-line tool through the service access into the annulus A. Moreover, in one embodiment, the sensor coupled to the wire-line cable may include a magnetostrictive sensor, a Villari effect sensor, a magnetic field sensor, an inductive coil, an acoustic transducer, an optical fiber sensor, and the like. In yet another embodiment, the sensor attached to the wire-line cable may include a temperature sensor, a humidity sensor, a chemical sensor, and the like. Additionally, the wire-line cable may include a power line and a communication line operatively coupled to the sensor. Furthermore, the power line and/or the communication line of the wire-line cable may be operatively coupled to the power supply 102 and the communication unit 108. The term operatively coupled, as used herein, may include wired coupling, wireless coupling, electrical coupling, magnetic coupling, radio communication, software based communication, or combinations thereof.

Figure 4:
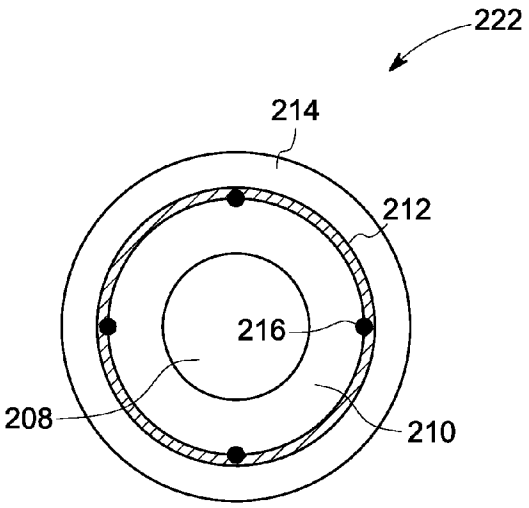
FIGS. 2-4 are diagrammatical representations of an exemplary embodiment of a portion of the system for subsea well monitoring of FIG. 1, according to aspects of the present disclosure.
Figure 3:
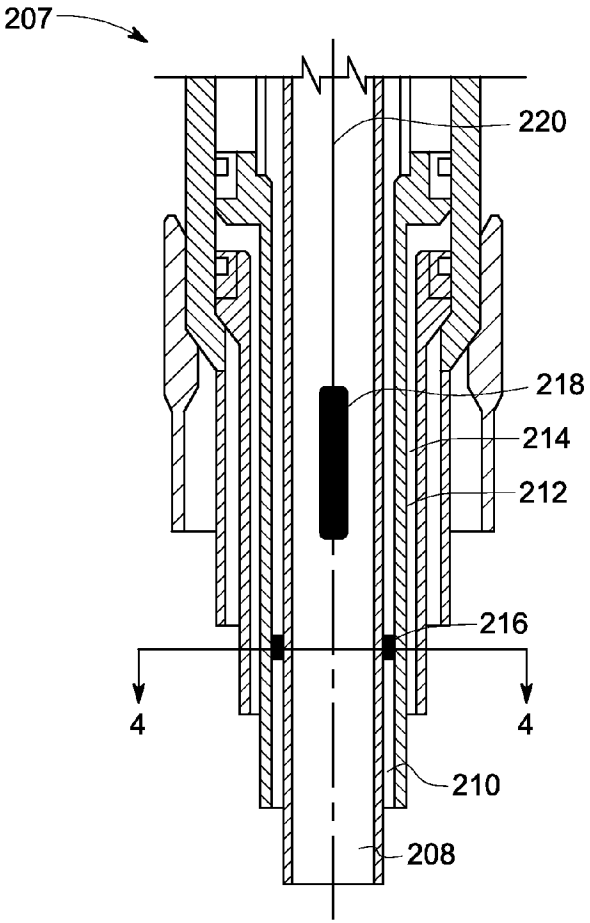
Figure 2:
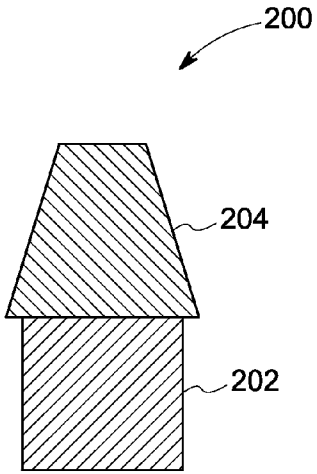

Referring now to FIGS. 2-4, diagrammatical representations of an exemplary embodiment of a portion of an exemplary system for subsea well monitoring, such as the system 100 of FIG. 1, are depicted. In particular, FIG. 2 is a diagrammatical representation 200 of a subsea well, such as the subsea well 104 of FIG. 1. The subsea well 200 may include a subsea wellhead 202 and a Christmas tree 204.

FIG. 3 is a diagrammatical representation 207 of the subsea well 200 of FIG. 2. Particularly, FIG. 3 depicts an arrangement of a first sensor in the subsea well 200. Also, FIG. 4 is a diagrammatical representation of a cross sectional view 222 of the subsea well 200.

In the example depicted in FIG. 3, the subsea well 207 may include a production tube 208, an annulus A 210, a casing wall 212, and an annulus B 214. The casing wall 212 may be disposed between the annulus A 210 and the annulus B 214. Additionally, the annulus B 214 may be coaxial to the annulus A 210 and may be placed exterior to the annulus A 210. In accordance with aspects of the present disclosure, a first sensor 216 such as the first sensor 106 of FIG. 1 may be disposed on or about the annulus A 210, the casing wall 212, or both the annulus A 210 and the casing wall 212. In the example of FIG. 3, the first sensor may include a fixed sensor 216. In another example, the first sensor may be a wire-line tool. Moreover, in the example of FIG. 3, the wire-line tool may be introduced into the production tube 208 from a service access. In a similar manner, in another example, the wire-line tool may be introduced into the annulus A 210 through a corresponding service access. The wire-line tool may include a sensor 218 operatively coupled to a wire-line cable 220. Furthermore, in one example, the annulus A may include both the fixed sensor 216 and wire-line tool with sensor 218 may be disposed on or about the annulus A 210.

FIG. 4 represents a cross-sectional view of the subsea well along line 4-4 of FIG. 3. In particular, FIG. 4 depicts examples of placement of the first sensor 216 along the casing wall 212 and inside the annulus A 210. The first sensor 216 may be disposed inside annulus A 210 and/or on the casing wall 212. In the example of FIG. 4, the casing wall 212 is depicted as including four fixed sensors 216 disposed circumferentially on the casing wall 212. Any variation in pressure inside the annulus A 210 and the annulus B 214 may be transferred to the casing wall 212. It may be noted that stress is a linear function of pressure. Accordingly, any variation in the pressure in the annulus A 210 and/or the annulus B may result in variation in stress on the casing wall 212. This stress may be captured by the first sensor 216 disposed on the casing wall 212. Also, the stress experienced by the casing wall 212 may also include residual stress, applied stress, bending stress, torsional stress, and stress due to stretching and compression of casing wall 212. In addition, other parameters like properties of the casing wall 212, such as, but not limited to, thickness, internal diameter, Young's modulus, and Poisson's ratio of the casing wall 212 may be used in the calculation of stress.

Figure 5:
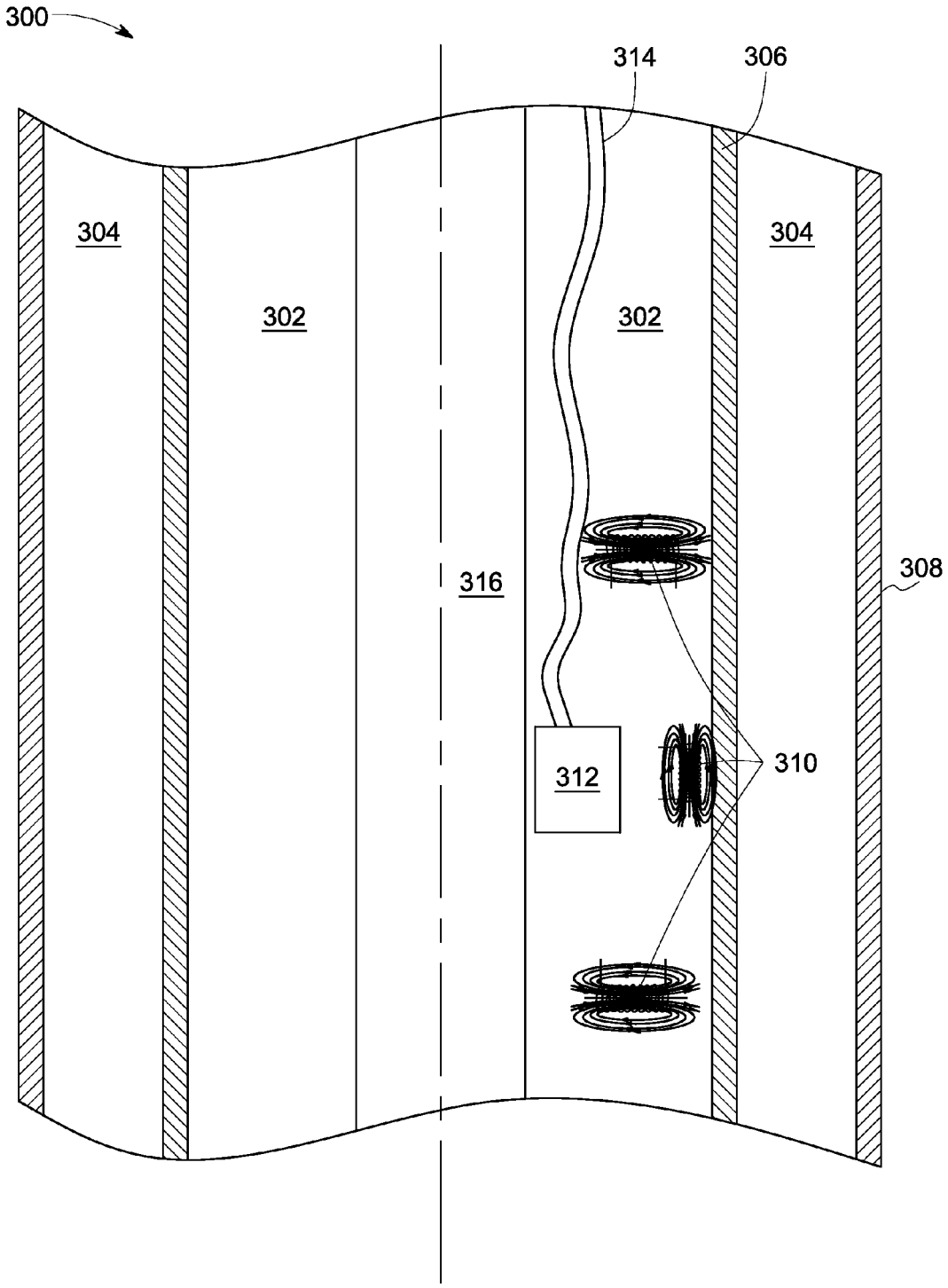
FIG. 5 is a diagrammatical representation of another exemplary embodiment of a portion of the system for subsea well monitoring of FIG. 1, according to aspects of the present disclosure.

Turning now to FIG, 5, a diagrammatical representation 300 of another exemplary embodiment of a portion of the exemplary system for subsea well monitoring, according to aspects of the present disclosure, is presented. Particularly, FIG. 5 depicts use of a first sensor, such as an inductive coil in an annulus A of the subsea well such as the subsea well 104 of FIG. 1. The system 300 includes an annulus A 302, an annulus B 304, a casing wall 306 between the annulus A 302 and the annulus B 304, an outer housing 308 of the annulus B 304, and a production tube 316. In one embodiment, plurality of inductive coils 310 may be disposed in the annulus A 302. These inductive coils 310 may also be coupled to the casing wall 306. In certain other embodiments, the inductive coils 310 may be magnetically coupled to the annulus A 302 and/or the casing wall 306. Also, the inductive coils 310 may be in the form of a fixed sensor.

Under normal operating conditions, the pressure may vary in the annulus A 302 and/or the annulus B 304. It may be noted that any fault in one or more components of the subsea well may result in variation of pressure in the annulus A 302 and/or the annulus B 304. These variations in the pressure in the annulus A 302 and annulus B 304 may be manifested in the form of stress on the casing wall 306. The stress experience by the casing wall 306 may result in changes in the magnetostrictive property of the casing wall 306. This stress experienced by the casing wall 306 may be detected by the inductive coils 310.

Moreover, the inductive coils 310 may be operatively coupled to a communication unit 312 such as the communication unit 108 of FIG. 1. In the example of FIG. 5, the communication unit 312 is disposed inside the annulus A 302. Any measurements may be communicated from the inductive coils 310 to the communication unit 312. Furthermore, a communication line 314 may be operatively coupled to the communication unit 312, where the communication line 314 may be configured to transfer any measurements made by the inductive coils 310 to a controller, such as the controller 110 of FIG. 1. By way of example, the communication line 314 may be configured to transfer a first parameter such as stress measured by the inductive coils 310 to the controller. The first parameter may be analyzed in a processing unit of the controller to identify any faults in one or more components of the subsea well. As noted hereinabove, the fault in one or more components of the subsea well may include a fault in the casing wall, cement employed in the subsea well, the production tube, a subsea wellhead, the tubing hanger, or other subsea well structures.

Figure 6:
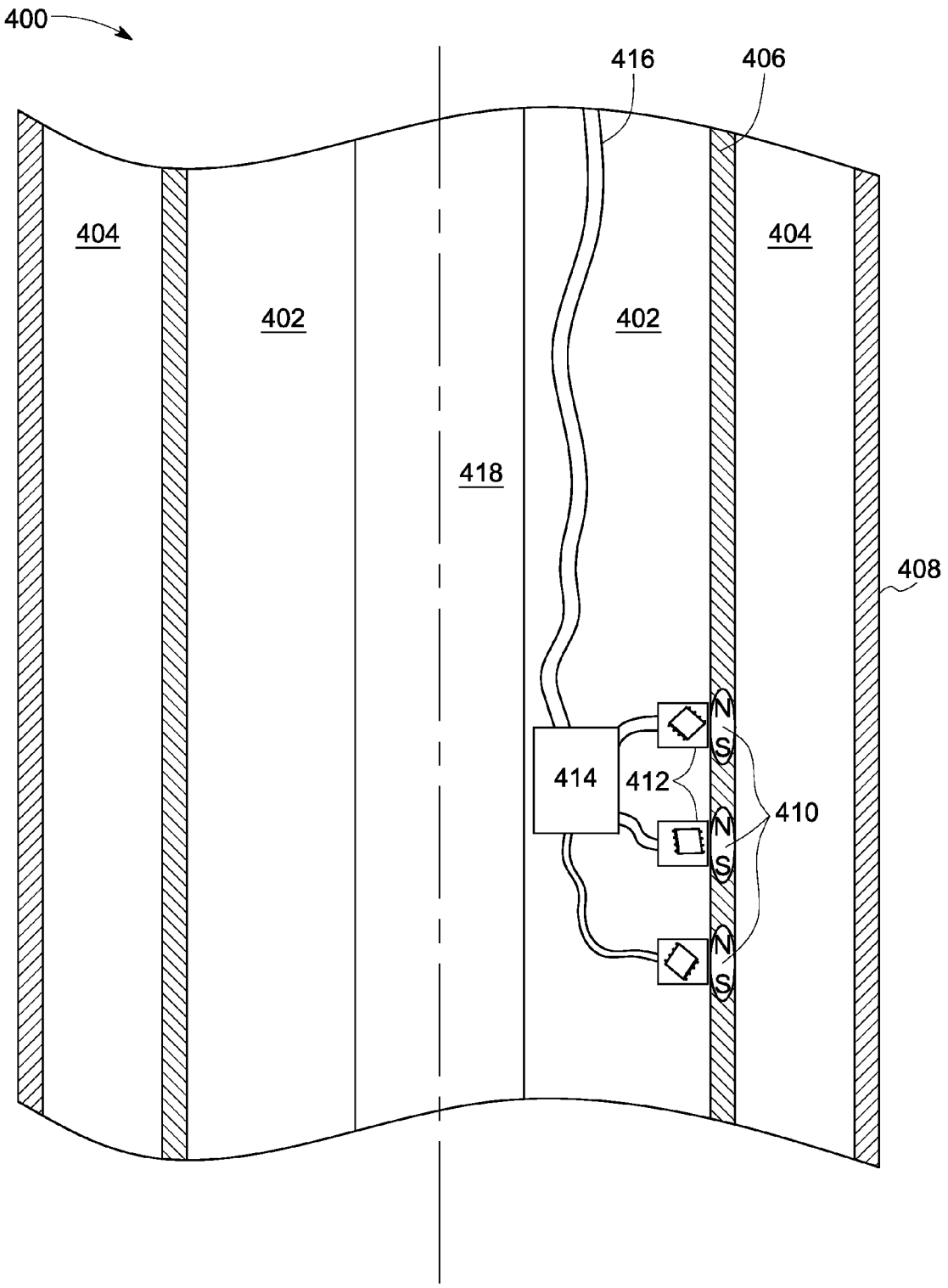
FIG. 6 is a diagrammatical representation of yet another exemplary embodiment of a portion of the system for subsea well monitoring of FIG. 1, according to aspects of the present disclosure.

Referring to FIG. 6, a diagrammatical representation 400 of yet another exemplary embodiment of a portion of the exemplary system for subsea well monitoring 100 (see FIG. 1), according to aspects of the present disclosure, is depicted. The system of FIG. 6 may include an annulus A 402, an annulus B 404, a casing wall 406 between the annulus A and the annulus B, an outer housing 408 of annulus B, and a production tube 418. In accordance with the aspects of the present disclosure, the casing wall 406, the production tube 418, and the like may include one or more segments with sensing capability. In one example, the segments with sensing capability may include one or more magnetically encoded regions. In another example, on application of acoustic signals on the casing wall 406, the segments with sensing capability may be formed on the casing wall 406. Accordingly, the casing wall 406 may be used as a sensor. In a similar fashion, the segments with sensing capability may be formed using other techniques.

In the example of FIG. 6, the casing wall 406 may include one or more magnetically encoded regions 410. These magnetically encoded regions 410 may be created using a determined value of electrical current, a determined value of magnetic field, or both the determined values of electrical current and magnetic field. In one embodiment, the magnetically encoded regions 410 may be formed on the casing wall 406 before installation and commissioning of the subsea well. If the annulus A 402 and the annulus B 404 are subject to variations in pressure due to any faults in the subsea well, the casing wall 406 may experience stress. The stress caused in the casing wall 406 may cause the magnetostrictive property of the casing wall 406 to change. This change in the magnetostrictive property of the casing wall 406 in turn may result in changes in the magnetic field associated with the magnetically encoded regions 410 of the casing wall 406. Accordingly, the changes in the magnetic field may be measured using a magnetic field sensor 412. It may be noted that the casing wall with the magnetically encoded region 410 may also be used as a sensor, in one example.

Moreover, in one embodiment, the magnetic field sensor 412 may be coupled to the casing wall 406. In one example, the casing wall 406 may be formed using a metal. Accordingly, in this example, the magnetic field sensor 412 may be coupled to the metal surface of the casing wall 406. In one another example, magnetic field sensor 412 may be coupled in close proximity to the metal surface of the casing wall 406. The magnetic field sensor 412 may be configured to communicate any measurements to a communication unit 414. Moreover, a communication line 416 may be used to transmit the measurements from the communication unit 414 to a controller, such as the controller 110 of FIG. 1, for processing. In particular, the controller may be configured to analyze the measurement to detect presence of any faults in one or more components of the subsea well. In certain embodiments, the measurement by the magnetic field sensor 412 may be transmitted wirelessly to the controller via an inductive pick-up, a radio frequency link, and the like. Also, the power to the magnetic field sensor 412 may be supplied wirelessly from a power supply.

In the example of FIG. 6, use of the magnetic field sensor 412 aids in identification of any fault occurring in one or more components of the subsea well. In one embodiment, multiple magnetic field sensors 412 may be employed to identify fault in one or more components of the subsea well. As previously noted, the fault in one or more components of the subsea well may include fault in the casing wall, the cement employed in the subsea well, the production tube, the subsea wellhead, the tubing hanger, or other subsea well structures.

In accordance with further aspects of the present disclosure, a magnetic stress sensor based technique such as MAPS™ may be employed to identify faults in one or more components of the subsea well. The one or more components of the subsea well may include the casing wall, the production tube, and the like. By employing the MAPS™ technique material properties such as stress in the casing wall, the production tube, and the like, may be measured using an electromagnetic probe. The electromagnetic probe may include an electromagnetic unit and a magnetic sensor. Further, the electromagnetic unit may include an electromagnetic core and two spaced apart electromagnetic poles. Also, the electromagnetic unit may generate an alternating magnetic field in the electromagnetic unit and consequently in the casing wall, the production tube and other components of the subsea well.

In addition, a signal such as the resulting alternating magnetic field may be sensed using the magnetic sensor. These signals may be influenced by geometrical parameters such as lift-off. In one example, the lift-off may include a gap or separation between the electromagnetic probe and the surface of the casing wall, the production tube, and the like. Accordingly, these influences may be separated from the signal sensed by mapping the in-phase and quadrature components. The signals sensed by the magnetic sensor may be resolved into in-phase and quadrature components. Hence, the material properties and/or the influences due to the geometrical parameters may be separately determined Accordingly, the material properties of the components of the subsea well may be identified, thereby aiding in enhanced detection of anomalies in the subsea well.

Figures 7, 8, 9:
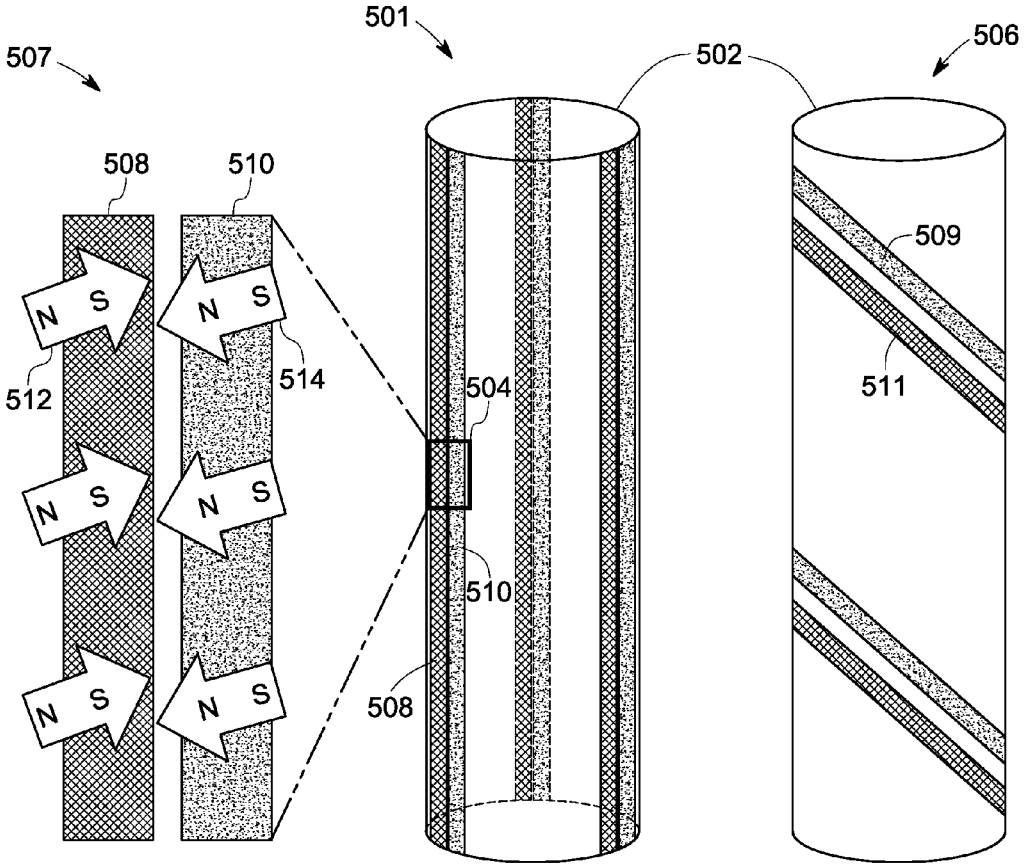
FIGS. 7-9 are diagrammatical representations of exemplary magnetization of a casing wall of the subsea well, according to aspects of the present disclosure.

FIGS. 7-9 are diagrammatical representations of exemplary magnetization of a casing wall of the subsea well for use in the system of FIG. 6, according to aspects of the present disclosure. In particular, FIG. 7 is a diagrammatical representation 501 depicting a magnetization of a casing wall 502 of the subsea well in a longitudinal configuration 504. By way of example, in the longitudinal configuration 504 lines of magnetization may run along a length of the casing wall 502 or magnetically encoded regions may be formed along the length of the casing wall 502. Furthermore, the magnetization in the longitudinal configuration 504 may include magnetized lines of at least two polarities 508, 510.

In a similar fashion, FIG. 8 depicts a diagrammatical representation 506 of magnetization of the casing wall 502 in a spiral configuration around the casing wall 502. The magnetization in spiral configuration 506 may include magnetized lines of at least two polarities 509, 511. Although the examples of FIGS. 7 and 8 depict magnetizations in longitudinal and spiral configurations, the magnetization of the casing wall 502 in other orientations is also contemplated. Also, the magnetization of the production tube and other similar subsea well components is also anticipated.

FIG. 9 is a diagrammatical representation 507 of an enlarged view of the magnetization of the casing wall 502 in the longitudinal configuration 504 of FIG. 7. As noted hereinabove, the magnetization in the longitudinal configuration 504 may include magnetized lines of at least two polarities 508, 510. By way of example, the two polarities may include a first polarity 508 and a second polarity 510. The magnetized line having the first polarity 508 may include magnetized domains 512 having an upward orientation. Also, the magnetized line having the second polarity 510 may include magnetization domains 514 having a downward orientation. Depending on the magnetoresistance of the metal of the casing wall 502 and the stress experienced by the metal of the casing wall 502, the orientation of the magnetization domains 512, 514 may change. In addition to the change in orientation of the magnetization domains 512, 514, the material susceptibility may also change. The change in material susceptibility may be sensed using magnetic field sensors/magnetic sensors, in one embodiment. Furthermore, the sensing of the change in material susceptibility may aid in identification of an anomaly of the subsea well.

Figure 10:
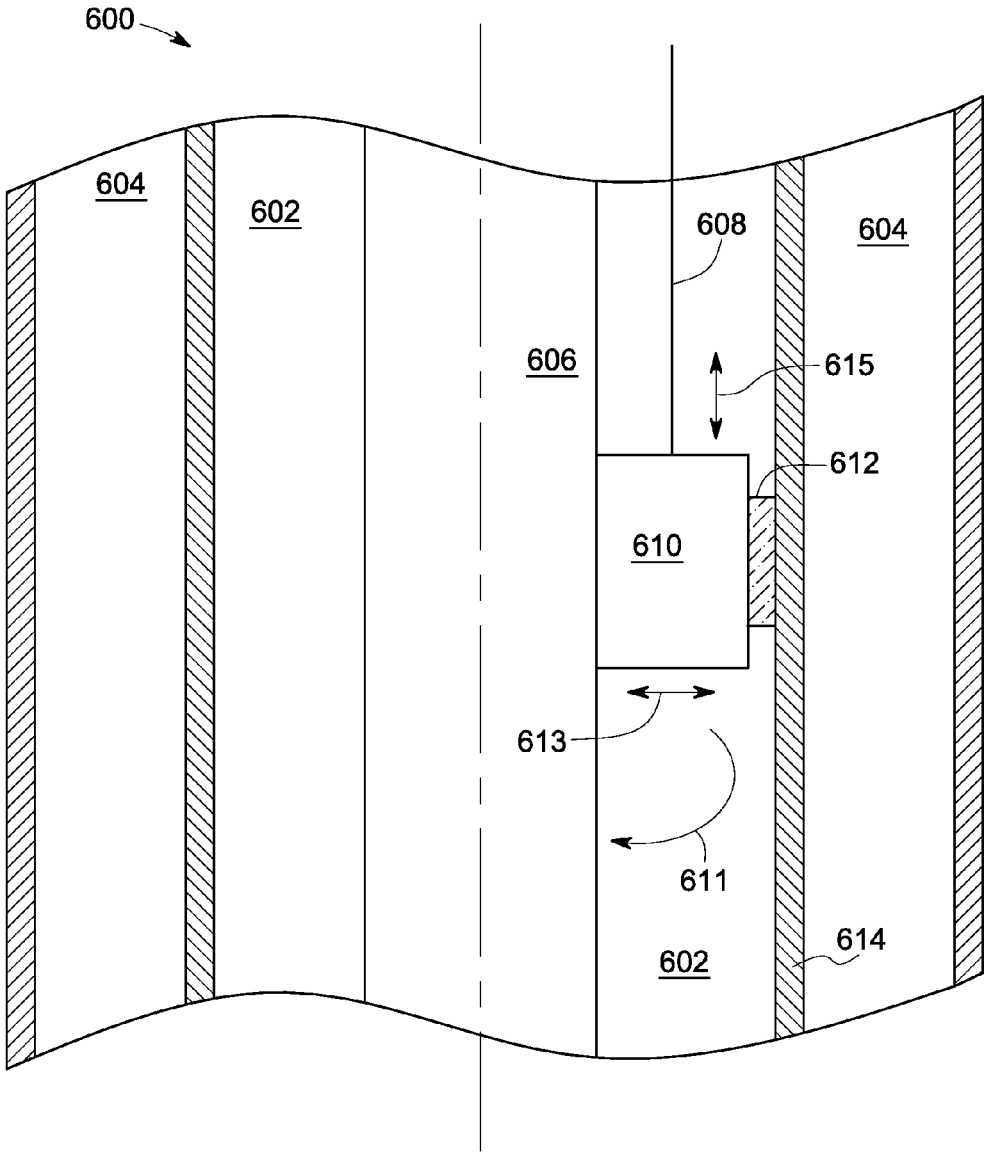
FIGS. 10-11 are diagrammatical representations of an exemplary locking mechanism for coupling a sensor to the subsea well of FIGS. 1-6, according to aspects of the present disclosure.
Figure 11:
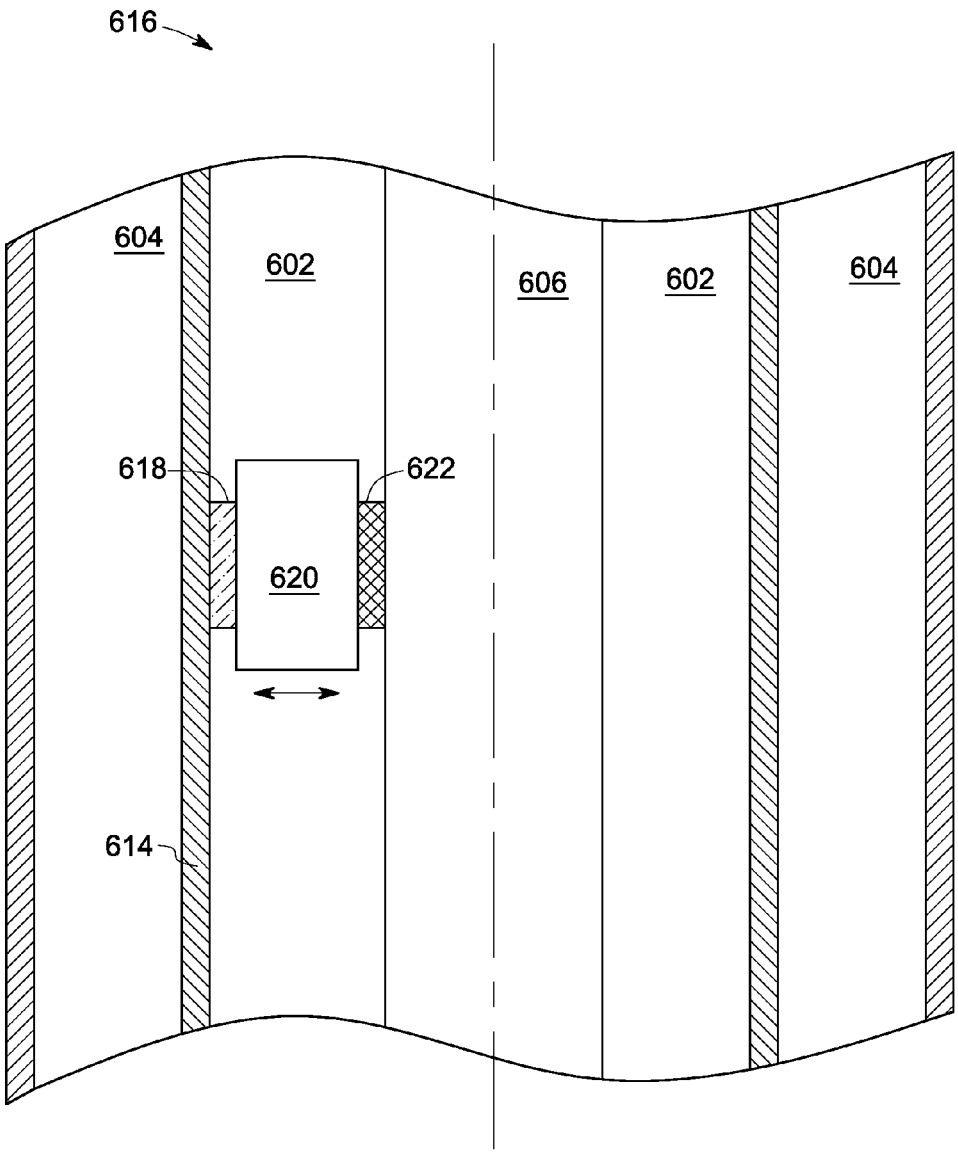

Turning now to FIGS. 10 and 11, diagrammatical representations of an exemplary locking mechanism for coupling a sensor, such as the first sensor 106 of FIG. 1 to the subsea well of FIGS. 1-6, according to aspects of the present disclosure, are depicted. Particularly, the locking mechanism may be employed to couple the sensor to a casing wall between annulus A and annulus B.

FIG. 10 depicts a locking mechanism 600 for locking a wire-line tool to a casing wall 614. The system of FIG. 10 may include an annulus A 602, an annulus B 604, and a production tube 606. As previously noted, the annulus A 602 may be coaxial and exterior to the production tube 606 and the annulus B 604 may be coaxial and exterior to the annulus A 602. Furthermore, a wire-line tool may be disposed into the annulus A 602 via a service access. The wire-line tool may include a wire-line cable 608 and a sensor 612. Moreover, the sensor 612 may be coupled to the wire-line cable 608 using a locking mechanism 610. In one example, the locking mechanism 610 may include a servomotor configured to move the sensor 612 in one or more of a circumferential direction 611, a horizontal direction 613, and a vertical direction 615, along the casing wall 614. The casing wall 614 may be a cylindrical surface, in one example.

Additionally, FIG. 11 represents a diagrammatical illustration 616 of a locking mechanism 620 for coupling a sensor 618, such as the first sensor 106 of FIG. 1, to the casing wall 614. In the example of FIG. 11 the sensor 618 may be a fixed sensor. Also, the sensor 618 may be fixedly coupled to the casing wall 614. The sensor 618 may be coupled via the locking mechanism 620 to a mount 622. In one example, the mount 622 may be coupled to the production tube 606. In one embodiment, the locking mechanism 620 may include a spring based mechanism, a hydraulic mechanism, a magnetic mechanism, and the like. The spring based mechanism may employ a spring. In one non-limiting example, the spring may include a bow spring, a coil spring, and the like. Also, the hydraulic mechanism may employ a hydraulic jack.

Figure 12:
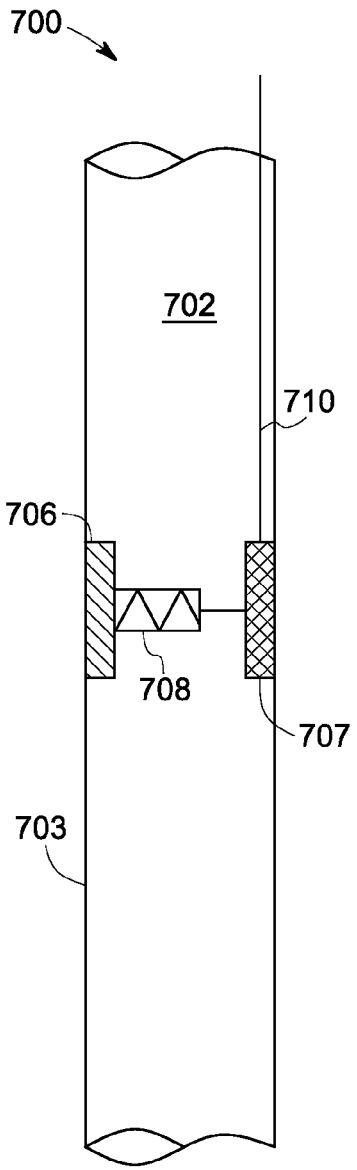
FIGS. 12-14 are diagrammatical representations of another exemplary embodiment of a locking mechanism for coupling a sensor to the subsea well of FIGS. 1-6, according to aspects of the present disclosure.
Figure 13:
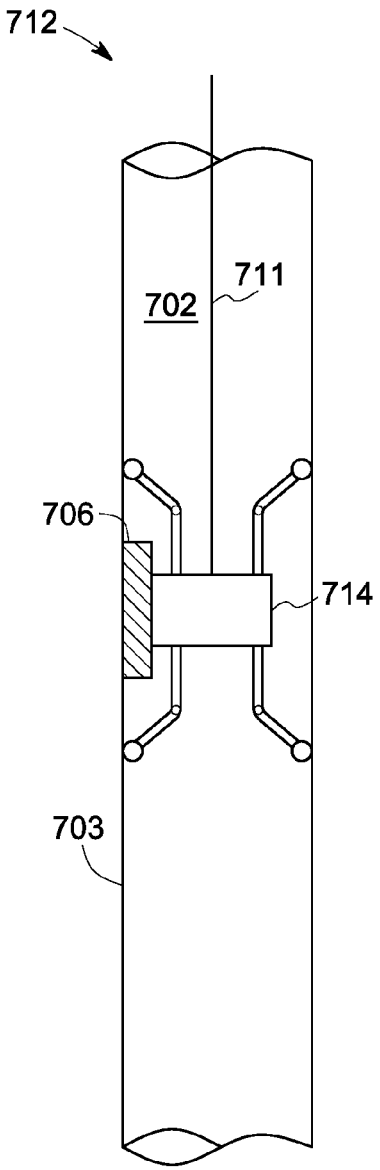
Figure 14:
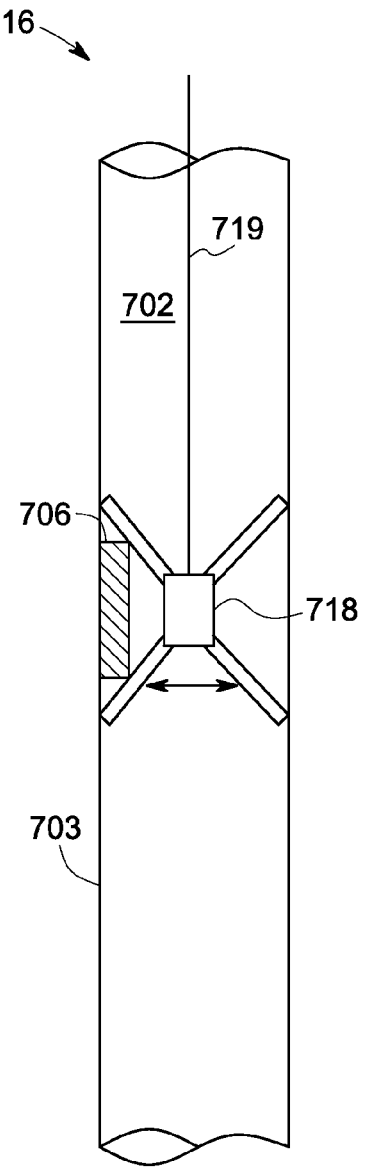

FIGS. 12-14 are diagrammatical representations of another exemplary embodiment of a locking mechanism for coupling a sensor, such as the first sensor 106 of FIG. 1, to the subsea well, according to aspects of the present disclosure. More particularly, FIGS. 12-14 depict a locking mechanism for locking a first sensor, such as a wire-line tool, disposed in an annulus A to a casing wall between the annulus A and annulus B.

Referring to FIG. 12, a diagrammatical representation 700 of a spring based locking mechanism is depicted. The system of FIG. 12 may include an annulus A 702, a casing wall 703, and a sensor 706. Furthermore, a locking mechanism 708, such as, but not limited to, a spring or a hydraulic jack may be employed to lock the sensor 706 to the casing wall 703. Reference numeral 707 may be representative of a mount to which the locking mechanism 708 may be coupled. A wire-line cable or a string 710 may be operatively coupled to the locking mechanism 708 for coupling the sensor to the casing wall 703.

Furthermore, FIG. 13 is a diagrammatical representation 712 of a crawler motor based mechanism for coupling the sensor to the casing wall 703. In this embodiment, the sensor 706 may be locked to the casing wall 703 by employing a crawler motor 714. The crawler motor 714 may further be employed to move the sensor 706 along the length and/or circumference of the casing wall 703. Also, in this embodiment, a wire-line cable or a string 711 may be operatively coupled to the crawler motor 714 to aid in coupling the sensor 706 to the casing wall 703. In one example, the crawler motor 714 may be energized by a power supply, such as the power supply 102 of FIG. 1.

In addition, FIG. 14 depicts a diagrammatical representation 716 of a mechanical scissors based mechanism. In the embodiment of FIG. 14, the sensor 706 may be locked to the casing wall 703 by employing mechanical scissors 718. Furthermore, the mechanical scissors 718 may be employed to move the sensor 706 along the length and/or the circumference of the casing wall 703. In one example, the mechanical scissors 718 may be electrically operated, hydraulically operated, and the like. A cable 719 may be operatively coupled to the mechanical scissors 718 to aid in coupling the sensor 706 to the casing wall 703.

Although the embodiments of FIGS. 12-14 depict different locking mechanisms for locking the sensor 706 to the casing wall 703, where the sensor 706 includes a wire-line tool, use of similar locking mechanisms for locking a fixed sensor are also contemplated. Also, in the examples of FIGS. 12-14, the locking mechanism may be supported on the outer wall of a production tube, such as the production tube 208 of FIG. 2.

Figure 15:
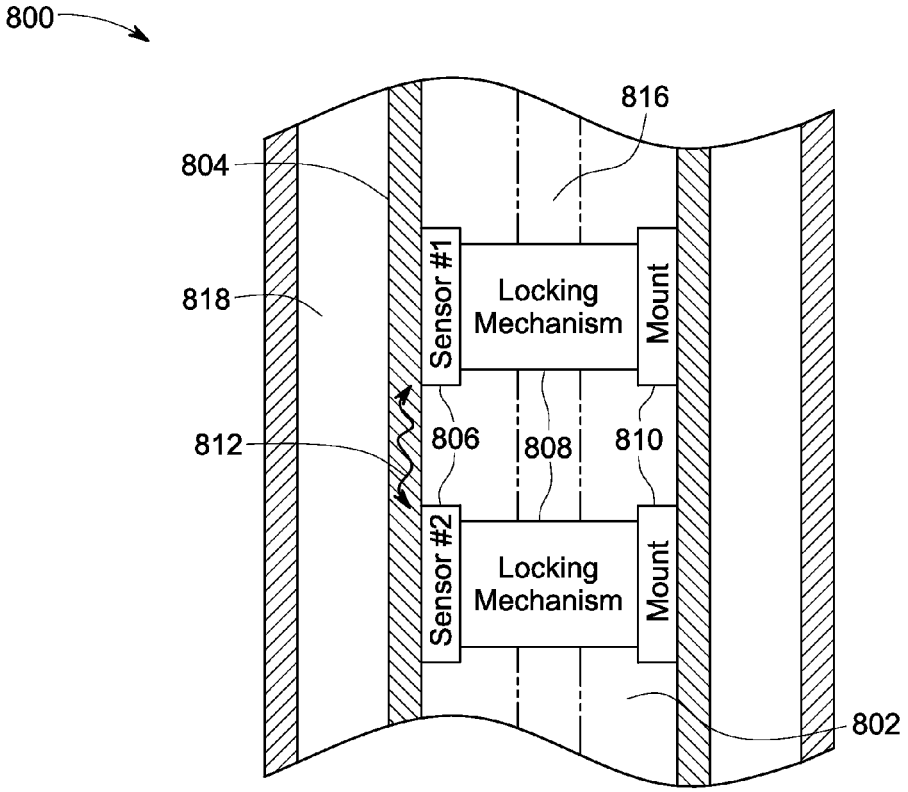
FIGS. 15-16 are diagrammatical representations of another exemplary embodiment of a portion of the system for subsea well monitoring of FIG. 1, according to aspects of the present disclosure.
Figure 16:
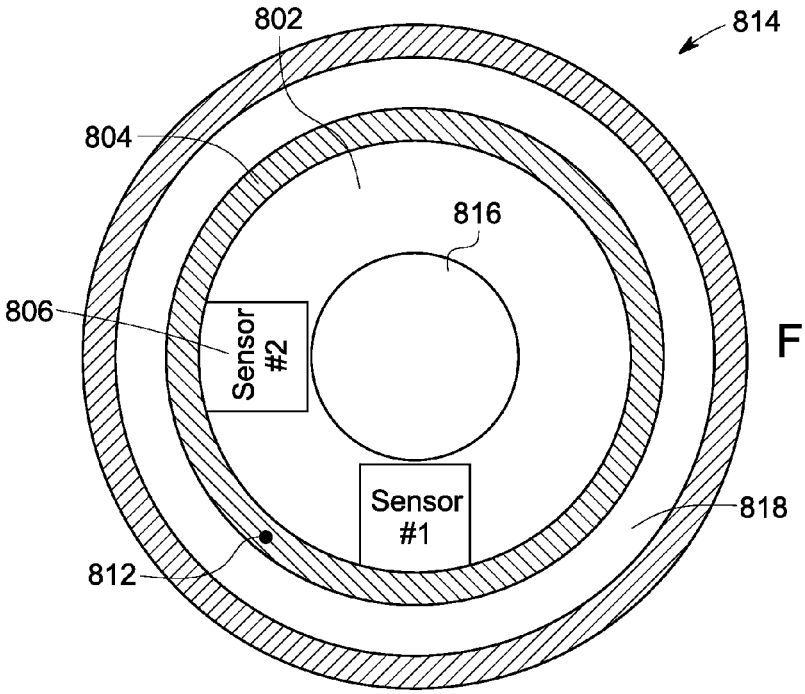

Turning now to FIGS. 15-16, diagrammatical representations of another exemplary embodiment of a portion of the exemplary system for subsea well monitoring 100 (see FIG. 1), according to aspects of the present disclosure, are depicted. In particular, FIG. 15 is a diagrammatical representation of a cross-sectional view 800 of an acoustic based sensing system for monitoring a subsea well is presented. In a presently contemplated configuration, the acoustic based sensing system may be disposed in an annulus A of the subsea well.

In the example of FIG. 15, the subsea well includes an annulus A 802, a casing wall 804, a production tube 816, and an annulus B 818. Moreover, in one embodiment, the acoustic based sensing system may include one or more acoustic sensors 806, a locking mechanism 808, and one or more mounts 810. The acoustic sensors 806 may be locked to a corresponding mount 810 by using the locking mechanisms 808. In one example, the acoustic sensor 806 may be a fixed sensor.

Furthermore, an acoustic signal 812 may be guided through the casing wall 804. The acoustic signal 812 may be guided through the casing wall 804 in different directions, such as, but not limited to, a horizontal direction and a vertical direction, in one example. Hence, the casing wall 804 may be configured to behave as a sensor. Due to variation in pressure in the annulus A 802 and/or the annulus B 818, the casing wall 804 may experience stress. The variation in pressure in the annulus A 802 and/or the annulus B 818 may be due to a fault in one or more of the annulus A and the annulus B. In accordance with aspects of the present disclosure, a differential quantity, such as, but not limited to, differential pressure between the annulus A 802 and the annulus B 818 may be employed to aid in identification of the fault. In addition, the stress in the casing wall 804 may cause time of flight of the acoustic signal 812 to vary. Accordingly, the variation in the time of flight of the acoustic signal 812 may be sensed by the acoustic sensors 806. Thus, the stress on the casing wall 804 may be determined The determined stress may then be analyzed to detect any faults in one or more components of the subsea well.

Referring to FIG. 16, cross sectional view 814 of subsea well that includes the acoustic based sensing system disposed in the annulus A is depicted. The sensor 806 may be disposed on the casing wall 804. Also, the sensor 806 may be disposed on the casing wall 804 using a locking mechanism (not shown) and one or more mounts (not shown). As noted hereinabove, the acoustic signal 812 may be guided through the casing wall 804. The stress in the casing wall 804 may cause time of flight of the acoustic signal 812 to vary, which may be sensed by the acoustic sensor 806. In one non-limiting example, the acoustic sensor 806 may be configured to accept signals within a certain window of time-of-flights. This aids in avoiding any unwanted cross-talks and/or interference from any reflected signals.

Figure 17:
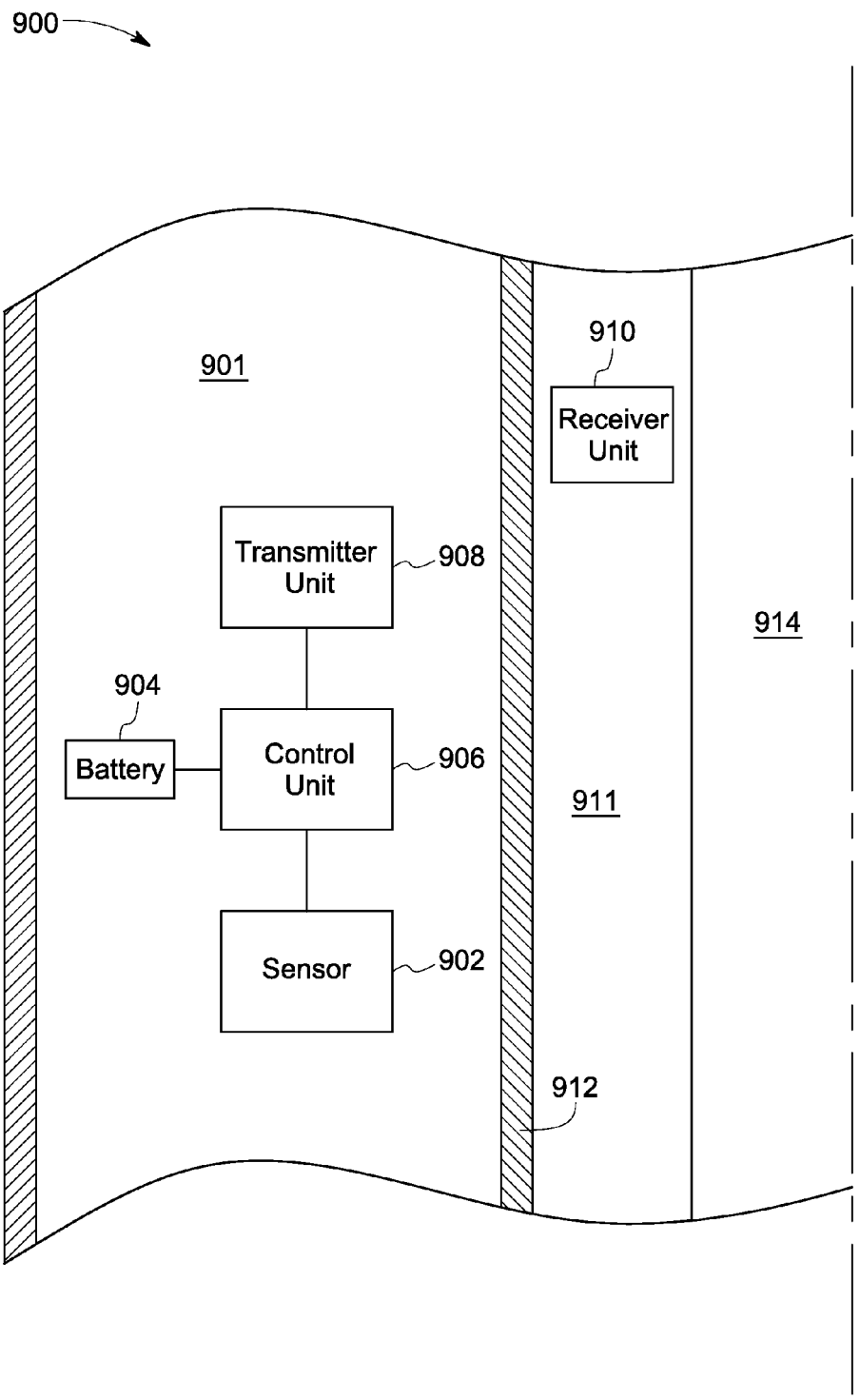
FIG. 17 is a diagrammatical representation of an exemplary embodiment of a system for monitoring a subsea well including a sensor inside an annulus B, according to aspects of the present disclosure.

Referring now to FIG. 17, a diagrammatical representation 900 of an exemplary embodiment of a subsea well having a sensor disposed on or within an annulus B, according to aspects of the present disclosure, is depicted. The subsea well 900 may include an annulus B 901, an annulus A 911, a casing wall 914, and a production tube 914. A sensor 902 may be disposed in the annulus B 901. It may be noted that the sensor 902 may also be referred to as a second sensor. The sensor 902 may be operatively coupled to a battery 904, where the battery 904 is configured to energize the sensor 902. The sensor 902 may be configured to measure parameters such as pressure, stress, and temperature in the annulus B 901. For ease of understanding, the parameters measured in the annulus B may be referred to as a second parameter. In one embodiment, the second parameter measured in the annulus B 901 may be representative of a baseline parameter/threshold value of the parameter for the annulus B. Also, the parameter may be measured in the annulus B 901 before sealing of the annulus B 901. Furthermore, the sensor 902 may be operatively coupled to a control unit 906 configured to analyze the second parameter. In one embodiment, the control unit 906 may be representative of the controller 110 of FIG. 1.

In addition, a transmitter unit 908 may be disposed in the annulus B 901 and may be operatively coupled to the sensor 902 via the control unit 906. The transmitter unit 908 may be configured to transmit the second parameter measured by the sensor 902 in annulus B 901 to a receiver unit 910. In a presently contemplated configuration, the receiver unit 910 is disposed in the annulus A 911. In one example, the sensor 902 may use a through-wall coupling, such as, but not limited to, acoustic coupling, low-frequency magnetic fields based coupling, a current pulse based coupling for transmitting the measured parameter corresponding to the annulus B to the receiver unit 910. In another non-limiting example, the transmitter unit 908 and the receiver unit 910 may form a part of a communication unit, such as the communication unit 108 of FIG. 1. The receiver unit 910 may be configured to transmit the measured parameter to a processing unit in a controller, such as the controller 110 of FIG. 1. The processing unit may use the parameter to detect the condition of the annulus B 901 before sealing/cementing or immediately after sealing/cementing.

Figure 18:
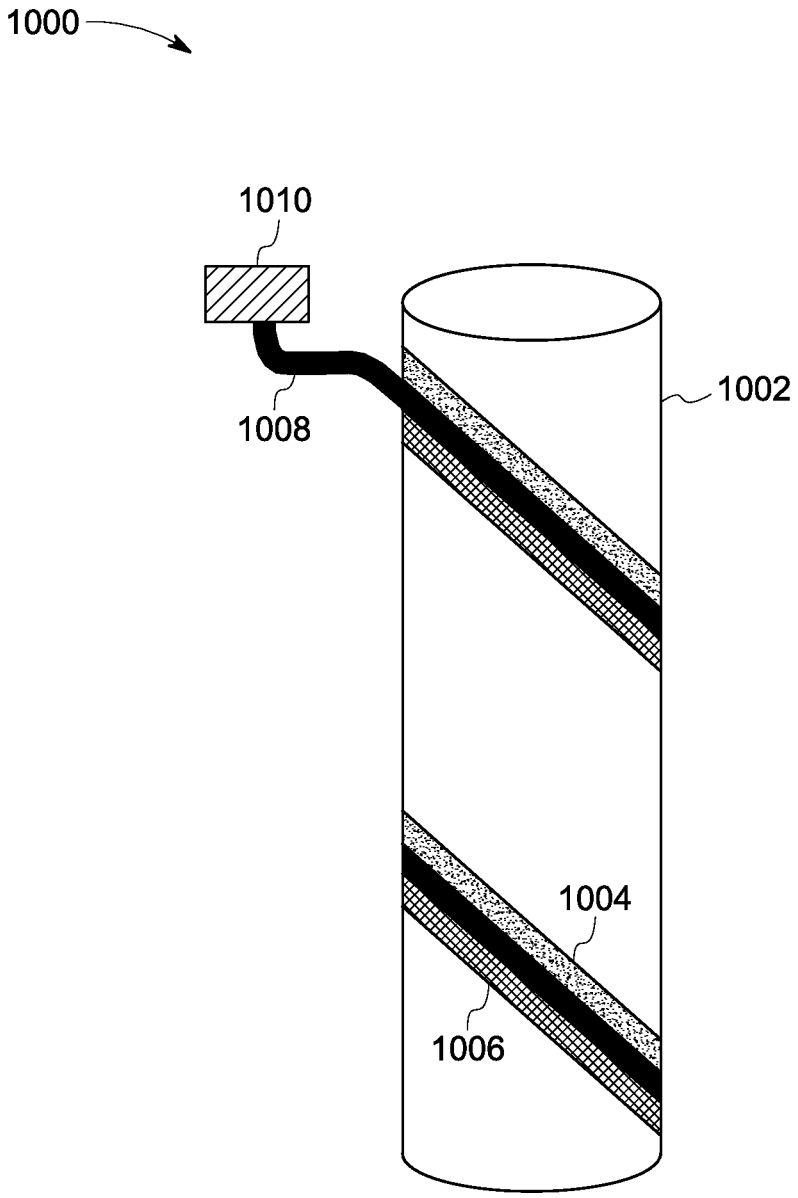
FIG. 18 is a diagrammatical representation of exemplary optical fiber based sensing of the subsea well for use in the system of FIG. 9, according to aspects of the present disclosure.

Turning now to FIG. 18, a diagrammatical representation 1000 of exemplary optical fiber based sensing of the subsea well, according to aspects of the present disclosure, is presented. Particularly, FIG. 18 depicts use of an optical fiber in the system of FIG. 8. The embodiment of FIG. 18 may include a casing wall 1002 that is disposed between annulus A and annulus B of a subsea well. Furthermore, the casing wall 1002 may include magnetized lines 1004, 1006. The magnetized lines may include a magnetized line having a first polarity 1004 and a magnetized line having a second polarity 1006. The magnetized lines having the first polarity 1004 and the magnetized lines having the second polarity 1006 may be formed in a spiral configuration about the casing wall 1002.

Additionally, an optical fiber 1008 may be wound in a spiral configuration between the magnetized lines 1004, 1006, in one example. Also, the optical fiber 1008 may be operatively coupled to an optical source and a detector unit 1010. The optical source and detector unit 1010 may be configured to guide light through the optical fiber 1008. Moreover, the optical source and detector unit 1010 may be configured to detect the light emitted by the optical fiber 1008.

The optical fiber 1008 may be configured to operate based on a magneto-optical effect. Accordingly, the optical fiber 1008 may be sensitive to changes in a magnetic field. Furthermore, the sensitivity of the optical fiber 1008 may be increased when the optical fiber 1008 is wound between the magnetized lines 1004, 1006. The orientation of the magnetization domains in the magnetized lines 1004, 1006 may change when the casing wall 1002 is subject to stress. As previously noted, the casing wall 1002 may experience a variation in stress as a result of variation of pressure in the annulus A and the annulus B. Also, the variation of pressure in the annulus A and the annulus B may occur due to a fault in one or more components of the subsea well. The optical fiber 1008 may be sensitive to the change in orientation of the magnetization domains. Accordingly, the optical properties of the optical fiber 1008 may change. Hence, the light guided by the optical fiber 1008 may also change, which in turn aids in identifying the stress experienced by the casing wall 1002.

In one embodiment, the optical fiber 1008 may be wound in a spiral configuration along the magnetized lines having the first polarity 1004 and the magnetized lines having the second polarity 1006. In another embodiment, the optical fiber 1008 may be wound in a spiral configuration on the outer periphery of the magnetized lines 1004, 1006. Although the example of FIG. 18 represents a spiral configuration of winding the optical fiber 1008, other types of winding of the optical fiber 1008 are also contemplated. Also, although FIG. 18 presents the magnetized lines in a spiral configuration, other configurations of the magnetized lines are also contemplated.

Figure 19:
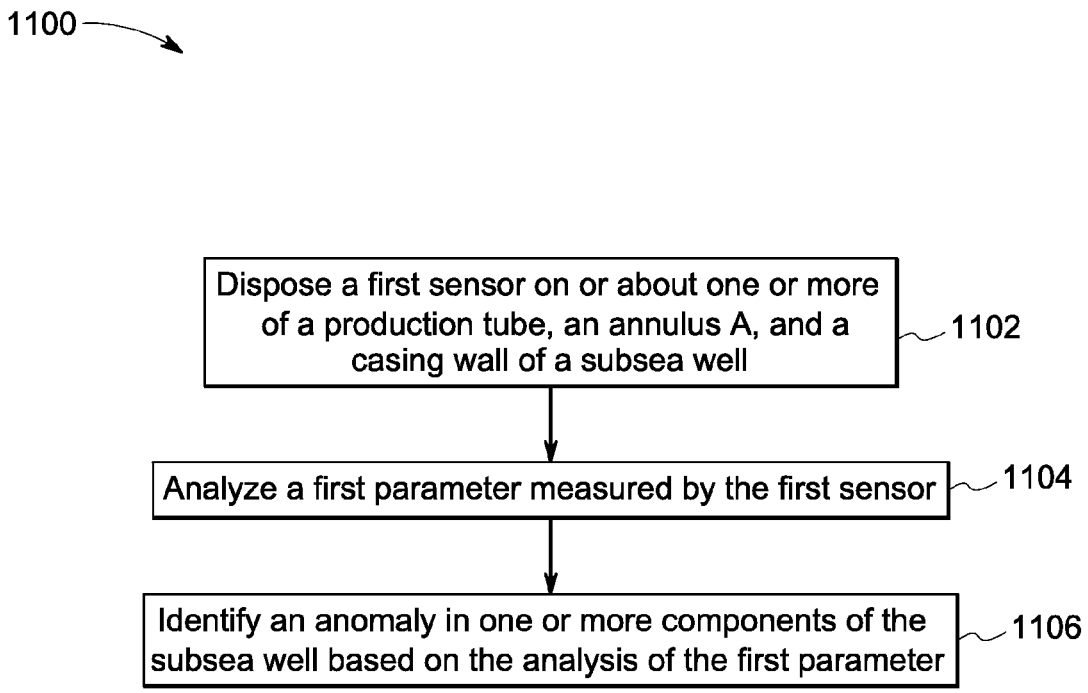
FIG. 19 is a flow chart of a method for monitoring a subsea well, according to aspects of the present disclosure.

FIG. 19 is a flow chart 1100 depicting a method of monitoring a subsea well, according to aspects of the present disclosure. As previously noted, the subsea well may include an annulus A, an annulus B, a casing wall, a production tube, and other components. The method begins at step 1102 where a first sensor may be disposed on or about one or more of the production tube, the annulus A, and the casing wall of a subsea well. The first sensor may be configured to measure a first parameter. The first parameter, as used herein, may include pressure, hoop stress, residual stress, bending stress, torque induced stress, tensional stress, longitudinal stress, and equivalents thereof. In one embodiment, the first parameter may include a signature that is representative of a variation in pressure with time in the annulus A. This signature may be employed to identify and/or predict a signature that is representative of a variation in pressure with time in the annulus B. Additionally, the first sensor may be locked on to the one or more of the production tube, the annulus A, and the casing wall via a locking mechanism.

Furthermore, at step 1104, the measured first parameter may be analyzed using a controller, such as controller 108 of FIG. 1. The analysis of the measured first parameter may include comparing the measured first parameter with a threshold value. In one embodiment, the threshold value may include a signature that is representative of a variation in pressure with time under a normal operating condition of the subsea well or in the absence of any faults in one or more components of the subsea well. In one non-limiting example, the threshold value may include stress measured or calculated under the normal operating condition of the subsea well. Also, in one example, the threshold value may be stored in the controller. It may be noted that the analysis of step 1104 may also be applied to a measured parameter corresponding to the annulus B before sealing/cementing of the annulus B.

At step 1106, an anomaly, if any, in one or more components of the subsea well may be identified based on analysis of the first parameter. In one embodiment, the anomaly in the one or more components of the subsea well may be identified by employing one or more of an analytical model, a physics based model, and a self-learning mechanism for analyzing the first parameter. The term anomaly, as used herein, may include a fault in one or more components of the subsea well. By way of example, the term anomaly may include faults in one or more of the casing wall, the production tube, the cement employed in the subsea well, the subsea wellhead, the tubing hanger, or other subsea well structures.

In one embodiment, on identification of an anomaly in one or more components of the subsea well, an alarm or an indicator may be generated. Also, once the anomaly in the one or more components of the subsea well are identified, a controller may be used to regulate the pressure in the production tube, the annulus A, and the like, to circumvent further variation in pressure in the production tube, the annulus A, and other components. In one example, the controller may include in-built intelligence to control the pressure/stress in the production tube, the annulus A, and/or the casing wall. Also, the variation in stress in the one or more components of the subsea well may be controlled. By way of example, once the anomalies in the one or more components of the subsea well are identified, an operator may be equipped to regulate the pressure in the production tube, the annulus A, the casing wall, and the like. Although the examples in FIGS. 1-19 allude to the identification of variation in pressure in annulus A and the annulus B, the identification of variation in pressure in other annuli of the subsea well is also contemplated.

According to aspects of the present disclosure, in one non-limiting example, the physics based model may be employed to identify faults in and/or monitor the condition of one or more subsea well components. Particularly, the physics based model may be employed to determine a parameter corresponding to a healthy state of the one or more components of the subsea well. The parameter corresponding to the healthy state of the subsea well components may be referred to as a threshold value. Further, a parameter corresponding to an actual condition of the one or more components of the subsea well may be determined The parameter corresponding to the actual condition of the subsea well components may be referred to as a first parameter.

Subsequently, the parameter corresponding to the healthy state may be compared to the parameter corresponding to the actual condition of the subsea well. If the parameter corresponding to the healthy state is substantially similar to the parameter corresponding to the actual condition, then the one or more components of the subsea well may be considered to be in a healthy condition. However, if the parameter corresponding to the actual condition is different from the parameter corresponding to the healthy condition of the subsea well, it may be determined that one or more components of the subsea well have an associated fault.

In certain embodiments, the parameter corresponding to the healthy state and the parameter corresponding to the actual condition of the subsea well may be a function of a plurality of factors, such as, but not limited to, mass of the fluid and/or hydrocarbons. In order to identify the factor responsible for the faulty condition, at least one of the plurality of factors, may be varied to cause the parameter corresponding to a healthy state to be substantially equal to the parameter corresponding to the actual condition of the subsea well. This factor may be identified as the factor responsible for the fault in one or more components of the subsea well. Once the factor is identified the type of fault in the subsea well may be identified based on the identified factor. In one example, the fault may be a leak in the one or more components of subsea well.

Moreover, the condition of the annulus A and/or the annulus B may be monitored by employing the physics based model. The pressure in the annulus A under design conditions may be a function of plurality of factors, such as, but not limited to, a current pressure of tubing, such as the production tube (see FIG. 2), a current temperature of the tubing, a property of the tubing, a property of the casing wall, a property of the subsea well, and/or an amount of fluid/mass of fluid in the annulus A. A parameter corresponding to a healthy state of the annulus A may be determined based on the physics based model. By way of example, the pressure in the annulus A in the healthy state or under design conditions may be determined using a physics based model employing function $f_1$.

$$P_{A\ ann_{design}}=f_1(P_{tubing},T_{tubing},Prop_{Tubing},Prop_{Casing},Prop_{Well},M_{fluid}) \quad (1)$$

where $P_{Tubing}$ is a current pressure of the tubing, $T_{Tubing}$ is a current temperature of the tubing, $Prop_{Tubing}$ is a property of the tubing, $Prop_{Casing}$ is a property of the casing wall, $Prop_{Well}$ is a property of the subsea well, $M_{fluid}$ is an amount of fluid/mass of fluid in the annulus A, and $P_{A\ ann_design}$ is a pressure of the annulus A under design conditions.

Subsequently, a parameter corresponding to the actual condition of the annulus A may be determined. By way of example, the actual pressure of the annulus A may be determined and/or measured.

$$P_{Aann_actual}=(P_{Aann_measured}) \quad (2)$$

where $P_{A\ ann_acutal}$ is the actual pressure in the annulus A and $P_{A\ ann_measured}$ is a current pressure in the annulus A.

Moreover, the pressure of the annulus A under design conditions, $P_{A\ ann_design}$ may be compared with the actual pressure in the annulus A, $P_{A\ ann_acutal}$. If $P_{A\ ann_design}$ and $P_{A\ ann_acutal}$ are substantially similar, it may be determined that an appropriate value of the factor $M_{fluid}$ is employed. However, if $P_{A\ ann_design}$ and $P_{A\ ann_acutal}$ are different, it may be determined that an incorrect value of the factor $M_{fluid}$ is considered. In one example, if $P_{A\ ann_design}$ and $P_{A\ ann_acutal}$ are different, then one or more of the amount of fluid ($M_{fluid}$), the type of fluid, property of tubing, property of casing wall, pressure and temperature of tubing and casing may be erroneous and/or incorrect.

Accordingly, the value of the factor $M_{fluid}$ may be varied until the pressure of the annulus A under design conditions, $P_{A\ ann_design}$ and the actual pressure of the annulus A $P_{A\ ann_acutal}$ are substantially similar. Based on the varied value of $M_{fluid}$, the fault such as an amount of leakage of fluid into or out of annulus A may be determined. Similarly, different factors of the function $f_1$ may be analyzed individually or in combination to determine the type of fault. Accordingly, the physics based model may aid in determination of faults in the annulus A. In a similar fashion, the condition of annulus B may also be monitored employing a physics based model.

The pressure of the annulus B under design conditions may also be a function of plurality of factors, such as, but not limited to, a current pressure of annulus A, such as the annulus A (see FIG. 2), a current temperature of the annulus A, a property of the tubing, a property of the casing wall, a property of the subsea well, and/or an amount of fluid/mass of fluid in the annulus B. A parameter corresponding to a healthy state of the annulus B may be determined based on the physics based model. By way of example, the pressure of annulus B during the healthy state/design conditions may be determined using a physics based model employing function $f_1$.

$$P_{B\ ann_design}=f_1(P_{Aann},T_{Aann},Prop_{Tubing},Prop_{Casing},Prop_{welb},M_{fluid}\ldots) \quad (1)$$

where $P_{Aann}$ is the current pressure of annulus A, $T_{Aann}$ is the current temperature of the annulus A, $Prop_{Tubing}$ is a property of the tubing, $Prop_{Casing}$ is a property of the casing wall, $Prop_{Well}$ is a property of the subsea well, $M_{fluid}$ is the amount of fluid/mass of fluid of annulus B, and $P_{B\ ann_design}$ is a pressure of the annulus B under design conditions.

Subsequently, a parameter corresponding to the actual condition of the annulus B may be determined by employing a function $f_2$.

$$P_{B\ ann_actual}=f_2(P_{A\ ann},T_{A\ ann},Prop_{Tubing},Prop_{Casing},Prop_{welb},\sigma) \quad (2)$$

where $P_{B\ ann_acutal}$ is an actual pressure of the annulus B, and $\sigma$ is stress experienced by casing wall.

Moreover, the pressure of the annulus B under design conditions, $P_{B\ ann_design}$ may be compared with the actual pressure in the annulus B, $P_{B\ ann_acutal}$. If $P_{B\ ann_design}$ and $P_{B\ ann_acutal}$ are substantially similar, it may be determined that an appropriate value of the factor $M_{fluid}$ is employed. However, if $P_{B\ ann_design}$ and $P_{B\ ann_acutal}$ are different, it may be determined that an incorrect value of the factor $M_{fluid}$ is considered. In one embodiment, the type of fluid, property of tubing, property of casing wall, pressure and temperature of tubing and casing may be incorrect.

Accordingly, the value of the factor $M_{fluid}$ may be varied until the pressure of the annulus B under design conditions, $P_{B\ ann_design}$ and the actual pressure of the annulus B, $P_{B\ ann_acutal}$ are substantially similar. Based on the varied value of $M_{fluid}$, the fault such as an amount of leakage of fluid into or out of annulus B may be determined. Similarly, different factors of the function $f_1$ may be analyzed individually or in combination to determine the type of fault. Accordingly, the physics based model may aid in determination of faults in the annulus B.

Furthermore, the foregoing examples, demonstrations, and process steps such as those that may be performed by the system may be implemented by suitable code on a processor-based system, such as a general-purpose or special-purpose computer. It should also be noted that different implementations of the present disclosure may perform some or all of the steps described herein in different orders or substantially concurrently, that is, in parallel. Furthermore, the functions may be implemented in a variety of programming languages, including but not limited to C++ or Java. Such code may be stored or adapted for storage on one or more tangible, machine readable media, such as on data repository chips, local or remote hard disks, optical disks (that is, CDs or DVDs), memory or other media, which may be accessed by a processor-based system to execute the stored code. Note that the tangible media may comprise paper or another suitable medium upon which the instructions are printed. For instance, the instructions may be electronically captured via optical scanning of the paper or other medium, then compiled, interpreted or otherwise processed in a suitable manner if necessary, and then stored in the data repository or memory.

The various embodiments of the systems and methods for monitoring the subsea well described hereinabove provided a robust method and system for monitoring the subsea well. Furthermore, since the exemplary systems and methods utilize a magnetostrictive technique, the sensing is robust against aging, dirt, moisture, changes in the composition of the ambient fluid, and the like. Moreover, since magnetostrictive properties vary with the mechanical properties of the casing wall of the subsea well, lifetime and stability of the sensing is also enhanced. Also, the system and method for monitoring may be employed to monitor different components of a subsea well such as the annulus A, the annulus B, and the production tube. In addition, since the system for monitoring may be deployed in the production tube, easier access, handling and testing of the monitoring system during and/or after the installation of the subsea well may be provided.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

The invention claimed is:

1. A system for monitoring a subsea well, comprising:

the subsea well, comprising:

a production tube;

an annulus A co-axial to the production tube and positioned exterior to the production tube;

an annulus B co-axial to the annulus A and positioned exterior to the annulus A;

a casing wall disposed between the annulus A and the annulus B;

a first sensor disposed on or about the production tube, the annulus A, the casing wall, or combinations thereof and configured to measure a first parameter, wherein the first sensor comprises:

a fixed sensor that is fixed relative to one or more of the production tube, the annulus A, the annulus B, and the casing wall; and a wire-line tool, wherein the wire-line tool is in a closed condition and configured to open up for measurement when introduced into at least one of the production tube and the annulus A;

a controller operatively coupled to the subsea well and configured to:

analyze the first parameter measured by the first sensor; and detect an anomaly in one or more components of the subsea well based on the analysis of the first parameter.

2. The system of claim 1, wherein the fixed sensor comprises a magnetic field sensor, a magnetostrictive sensor, an inductive coil, a Villari effect sensor, an acoustic transducer, an optical fiber sensor, a temperature sensor, or combinations thereof.

3. The system of claim 1, wherein the wire-line tool comprises a sensor operatively coupled to a wire-line cable, and wherein the sensor comprises magnetic field sensor, a magnetostrictive sensor, an inductive coil, a Villari effect sensor, an acoustic transducer, an optical fiber sensor, a temperature sensor, or combinations thereof.

4. The system of claim 1, further comprising a locking mechanism configured to operatively couple the first sensor to one or more of the production tube, the annulus A, and the casing wall.

5. The system of claim 4, wherein the locking mechanism comprises a spring based mechanism, a hydraulic mechanism, a servomotor actuation mechanism, a magnetic mechanism, or combinations thereof.

6. The system of claim 1, wherein the casing wall comprises one or more segments configured to sense the first parameter.

7. The system of claim 6, wherein the one or more segments with sensing capability comprise one or more magnetically encoded regions.

8. The system of claim 7, wherein the one or more magnetically encoded regions comprise a plurality of magnetized lines having at least two polarities formed along a length of the casing wall.

9. The system of claim 7, wherein the one or more magnetically encoded regions comprise a plurality of magnetized lines having at least two polarities formed in a spiral configuration around the casing wall.

10. The system of claim 9, further comprising an optical fiber disposed in a spiral configuration around the casing wall, wherein the optical fiber is wound in a spiral configuration between the plurality of magnetized lines.

11. The system of claim 1, further comprising a second sensor disposed on or about the annulus B and configured to measure one or more of a pressure and a temperature on or about the annulus B.

12. The system of claim 1, wherein the first parameter comprises a pressure, compression stress, hoop stress, residual stress, longitudinal stress, tensional stress, bending stress, torque induced stress, or combinations thereof.

13. A method for monitoring a subsea well, the method comprising:

disposing a first sensor on or about one or more of a production tube, an annulus A, and a casing wall of the subsea well, wherein the annulus A is co-axial to the production tube and positioned exterior to the production tube, an annulus B is co-axial to the annulus A and positioned exterior to the annulus A, and the casing wall is disposed between the annulus A and the annulus B, wherein the first sensor is configured to measure a first parameter, wherein the first sensor comprises a fixed sensor that is fixed relative to one or more of the production tube, the annulus A, the annulus B, and the casing wall and a wire-line tool, and wherein the wire-line tool is in a closed condition and configured to open up for measurement when introduced into at least one of the production tube and the annulus A;

analyzing the measured first parameter using a controller; and identifying an anomaly in one or more components of the subsea well based on the analysis of the first parameter.

14. The method of claim 13, further comprising magnetizing the casing wall of the subsea well.

15. The method of claim 14, wherein magnetizing the casing wall comprises applying a determined value of an electrical current, a determined value of a magnetic field, or a combination thereof to the casing wall.

16. The method of claim 14, wherein magnetizing the casing wall comprises magnetizing the casing wall in a spiral configuration.

17. The method of claim 14, wherein magnetizing the casing wall comprises magnetizing the casing wall in a longitudinal configuration.

18. The method of claim 13, further comprising locking the first sensor to one or more of the production tube, the annulus A, and the casing wall, via a locking mechanism.

19. The method of claim 13, further comprising disposing a second sensor on or about the annulus B of the subsea well before sealing the annulus B.

20. The method of claim 19, wherein the second sensor is configured to measure one or more of a pressure, a stress, and a temperature on or about the annulus B.

21. The method of claim 13, wherein the anomaly comprises a fault in one or more of the casing wall, the production tube, cement employed in the subsea well, a subsea wellhead, a tubing hanger, or combinations thereof.

22. The method of claim 13, wherein identifying the anomaly in one or more components of the subsea well based on the analysis of the first parameter comprises employing a physics based model.

23. The method of claim 22, wherein the analysis of the first parameter employing the physics based model comprises:

determining a parameter corresponding to a healthy state of the one or more components of the subsea well;

identifying a parameter corresponding to an actual condition of the one or more components of the subsea well; and comparing the parameter corresponding to the healthy state of the one or more components of the subsea well to the parameter corresponding to the actual condition of the one or more components of the subsea well to identify the anomaly in the one or more components of the subsea well.

24. A non-transitory computer readable medium comprising one or more tangible media, wherein the one or more tangible media comprise routines for causing a computer to perform the steps of:

measuring a first parameter using a first sensor disposed on or about one or more of a production tube, an annulus A, and a casing wall of a subsea well, wherein the annulus A is co-axial to the production tube and positioned exterior to the production tube, an annulus B is co-axial to the annulus A and positioned exterior to the annulus A, and the casing wall is disposed between the annulus A and the annulus B, wherein the first sensor comprises a fixed sensor that is fixed relative to one or more of the production tube, the annulus A, the annulus B, and the casing wall and a wire-line tool, and wherein the wire-line tool is in a closed condition and configured to open up for measurement when introduced into at least one of the production tube and the annulus A;

analyzing the measured first parameter using a controller; and identifying an anomaly in one or more components of the subsea well based on the analysis of the first parameter.

* * * * *